US007342167B2

(12) United States Patent
Cremer et al.

(10) Patent No.: US 7,342,167 B2
(45) Date of Patent: Mar. 11, 2008

(54) APPARATUS AND METHOD FOR GENERATING AN ENCODED RHYTHMIC PATTERN

(75) Inventors: Markus Cremer, Ilmenau (DE); Matthias Gruhne, Legefeld (DE); Jan Rohden, Ilmenau (DE); Christian Uhle, Erlangen (DE)

(73) Assignee: Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 11/680,490

(22) Filed: Feb. 28, 2007

(65) Prior Publication Data

US 2007/0199430 A1 Aug. 30, 2007

Related U.S. Application Data

(62) Division of application No. 10/961,957, filed on Oct. 8, 2004, now Pat. No. 7,193,148.

(51) Int. Cl.
*G10H 1/40* (2006.01)
*G10H 7/00* (2006.01)
*G10H 5/00* (2006.01)

(52) U.S. Cl. ..... 84/611; 84/609; 84/635; 84/649; 84/667

(58) Field of Classification Search ..... 84/611, 84/635, 609, 649, 667
See application file for complete search history.

(56) References Cited

U.S. PATENT DOCUMENTS 4,960,031 A * 10/1990 Farrand ..... 84/609
5,138,928 A * 8/1992 Nakajima et al. ..... 84/635
5,177,313 A * 1/1993 Miyamoto ..... 84/611
5,491,297 A * 2/1996 Johnson et al. ..... 84/609
5,606,144 A * 2/1997 Dabby ..... 84/649
5,670,729 A * 9/1997 Miller et al. ..... 84/609
5,723,802 A * 3/1998 Johnson et al. ..... 84/609
5,736,665 A * 4/1998 Fukumoto et al. ..... 84/667
5,918,223 A * 6/1999 Blum et al. ..... 707/1
6,011,212 A * 1/2000 Rigopulos et al. ..... 84/667
6,028,262 A * 2/2000 Minamitaka ..... 84/611
6,177,624 B1 * 1/2001 Takahashi et al. ..... 84/609
6,326,538 B1 * 12/2001 Kay ..... 84/635
6,576,828 B2 * 6/2003 Aoki et al. ..... 84/635
2004/0094019 A1 * 5/2004 Herre et al. ..... 84/611

(Continued)

OTHER PUBLICATIONS

Uhle, C., et al. "Estimation of Tempo, Micro Time and Time Signature from Percussive Music" Proc. of the 6th Intl. Conference on Digital Audio Effects. Sep. 9, 2003. London, U.K.

(Continued)

*Primary Examiner*—Lincoln Donovan
*Assistant Examiner*—Christina Russell
(74) *Attorney, Agent, or Firm*—Michael A. Glenn; Glenn Patent Group

(57) ABSTRACT

An encoded rhythmic pattern has several groups of velocity values, wherein the velocity values are sorted, such that the groups are included in sequence in an encoded rhythmic pattern. Now, the velocity values concentrated at the beginning of the encoded rhythmic pattern have a higher importance for characterizing the rhythmic gist of a piece of music than velocity values included in additional groups of velocity values. By using such an encoded rhythmic pattern, an efficient database access can be performed.

5 Claims, 12 Drawing Sheets

OTHER PUBLICATIONS

Scheirer, E. "Tempo and Beat Analysis of Acoustic Musical Signals" Journal of the Acoustical Society of America. American Institute of Physics. Jan. 1998. vol. 103, No. 1. New York, US.

Sepppdnen, J. "Tatum Grid Analysis of Musical Signals." Applications of Signal Processing to Audio and Acoustics. IEEE Workshop. Oct. 21-24, 2001. Piscataway, NJ.

* cited by examiner

Example 1: meter = 4/4; micro time = 2; resulting size = 4 * 2 = 8

| Part of the bar | 1 | 1+ | 2 | 2+ | 3 | 3+ | 4 | 4+ | 20c |
|---|---|---|---|---|---|---|---|---|---|
| Grid position | 1 | 2 | 3 | 4 | 5 | 6 | 7 | 8 | 20a |
| velocity | 100 | 0 | 112 | 0 | 150 | 68 | 120 | 0 | 20b |

FIGURE 2A
(PRIOR ART)

| Part of the bar | 1 | 1+ | 2 | 2+ | 3 | 3+ | 4 | 4+ | |
|---|---|---|---|---|---|---|---|---|---|
| Rhythmic level | *** | * | ** | * | *** | * | ** | * | 21 |
| Grid position | 1 | 2 | 3 | 4 | 5 | 6 | 7 | 8 | |
| prime index | 1 | 5 | 3 | 6 | 2 | 7 | 4 | 8 | 22 |
| velocity | 100 | 0 | 112 | 0 | 150 | 68 | 120 | 0 | |

FIGURE 2B

All velocity values equal to zero and the corresponding prime indexes (elements) are deleted:

| Rhythmic level | *** | ** | *** | * | ** | |
|---|---|---|---|---|---|---|
| Prime index | 1 | 3 | 2 | 7 | 4 | 22 |
| velocity | 100 | 112 | 150 | 68 | 120 | 23 |

FIGURE 2C

According to the ascending order of the prime indexes the elements will be rearranged, resulting in the final representation:

| | Rhythmic level | *** | *** | ** | ** | * | Encoded |
|---|---|---|---|---|---|---|---|
| 22 | Prime index | 1 | 2 | 3 | 4 | 7 | rhythmic |
| 23 | velocity | 100 | 150 | 112 | 120 | 68 | pattern |

first group second group third group

FIGURE 2D

Example 2: meter = 4/4; micro time = 3; resulting size = 4 * 3 = 12

| Part of the bar | 1-1 | 1-2 | 1-3 | 2-1 | 2-2 | 2-3 | 3-1 | 3-2 | 3-3 | 4-1 | 4-2 | 4-3 |
|---|---|---|---|---|---|---|---|---|---|---|---|---|
| Rhythmic level | *** | * | * | ** | * | * | *** | * | * | ** | * | * |
| Grid position | 1 | 2 | 3 | 4 | 5 | 6 | 7 | 8 | 9 | 10 | 11 | 12 |
| velocity | 180 | 0 | 100 | 200 | 0 | 99 | 190 | 0 | 97 | 205 | 0 | 101 |

FIGURE 3A

All velocity values equal to zero and the corresponding prime indexes (elements) are deleted:

| Rhythmic level | *** | * | ** | * | *** | * | ** | * |
|---|---|---|---|---|---|---|---|---|
| Index | 1 | 3 | 4 | 6 | 7 | 9 | 10 | 12 |
| velocity | 180 | 100 | 200 | 99 | 190 | 97 | 205 | 101 |

FIGURE 3B

According to the ascending order of the prime indexes the elements will be rearranged, resulting in the final representation:

| Rhythmic level | *** | *** | ** | ** | * | * | * | * |
|---|---|---|---|---|---|---|---|---|
| Prime index | 1 | 7 | 4 | 10 | 3 | 9 | 6 | 12 |
| velocity | 180 | 190 | 200 | 205 | 100 | 97 | 99 | 101 |

1st group 2nd group 3rd group

FIGURE 3C

```
<!-- ######################################### -->
<! – Definition of AudioPattern DS                -->
<! --#########################################  -->
<complexType name="AudioPatternType">
  <complexContent>
    <extension base="mpeg7:AudioDSType">
      <sequence>
        <element name= "Meter" type="mpeg7:MeterType" />
        <element name="Bpm" type="mpeg7:bpmType" minOccurs="0" />
40      <element name="Pattern" type="mpeg7:RhythmicPatternType"
          maxOccurs= „unbounded" />
        <element name="TimePoint" type="mpeg7:BasicTimePointType"
          minOccurs="0" />
      </sequence>
    </extension>
  </complexContent>
<complexType>
```

FIGURE 4A

| Name | Definition |
|---|---|
| AudioPatternType | A structure providing a compact and efficient representation of rhythmical patterns. |
| Pattern | The rhythmical pattern of an audio signal of AudioRhythmicPatternType data. |
| Meter | The information about the meter of AudioPatternType data |
| Bpm | The information about the tempo in bpm (beats per minute) of AudioPatternType data |
| TimePoint | The information about the TimePoint of AudioPatternType data |

FIGURE 4B

```
<! - -
##################################### -->
<! - - Definition of AudioRhythmicPatternDS
<! --#######################################
  - ->
<complexType name="AudioRhythmicPatternType">
  <all>

    <element     name="BarNum"          type="unsigned8" />
    <attribute   name="InstrumentID"    type="unsigned7" />
    <element     name="PrimeIndex"      type="mpeg7:integerVector" />
    <element     name="Velocity"        type="mpeg7:integerVector" />
    <element     name="Microtime"       type="unsigned5" />
    <element   name="Bpm"               type="mpeg7:BpmType" />
  <all>
</complexType>
```

FIGURE 5A

| Name | Definition |
|---|---|
| AudioRhythmicPatternType | A representation of a rhythmical pattern of an audio signal. |
| BarNum | Indicates the temporal order of consecutive *AudioRhythmicPatternType* data.. |
| InstrumentID | Integer number referring to an instrument sound |
| PrimeIndex | Integer vector indicating the initial index within an *AudioRhythmicPatternType* |
| Velocity | Integer vector indicating the velocity of the elements in *AudioRhythmicPatternType* |
| MicroTime | Integer holding the information about the microtime in *AudioRhythmicPatternType*. MicroTime is defined as the close to integer ratio of the period between two beats and the period of the pulse series with respect to the lowest hierarchic rhythmical pulse level. |
| Bpm | The information about the tempo in bpm (beats per minute) of *AudioPatternType* data |

FIGURE 5B

The calculation of each *PrimeIndex* of the example pattern may be done in the following manner:

1. Vector of prime factorization of the nominator of the meter:
   nomVec = $\{nom_1 \ldots nom_k\}$ sorted by size with the largest value first = {2,2} for 4/4meter 2. Vector of prime factorization of the micro time:
   mtvec = $\{mt_1 \ldots mt_k\}$ = {2} for microtime =2

3. calcation of the prime indices from the grid positions:

```
patternLength = product(nomVec) *product(mtVec)
vector primeVec() with pattenLength Elements set to 0
primeIndex = 1
primeProduct = 1


for i=1 : length(nomVec)
{
        primeProduct* =nomVec (i)

        while (count < patternLength)
        {
                if ((count/ (patternLenght/tempPrimeVec)== integer)
                {
                        if (primeVec [count] ===)
                        {
                                primeVec[count] = primeIndex;
                                primeIndex++;

                        }
                }
                count++;
        }
}


for i=1 . length(mtVec)
{
        primeProduct *=mtVec (i)

        while (count < patternLenght)
        {
                if((count/ (patternLength/tempPrimeVec) == Integer)
                {
                        if (primeVec[count] ==0)
                        {
                                primeVec[count] = primeIndex;
                                primeIndex++;

                        }
                }
                count++;
        }
}
```

FIGURE 7

```
function outVec = mp7AudioRhythmicPatternSort (nomVec, mtVec)


patternLength = prod(nomVec) * prod(mtVec);
primeVec = zeros (1, patternLength);
gridPosition = 0;
primeIndex = 1;

i=0;
j=0;
k=0;
tempPrimeVec = 1;
zeroSwitch = 0;

for i=1: length (nomVec)

        tempPrimeVec = tempPrimeVec*nomVec (i);
        count = 1;
        while (count < patternLength+1)
                ganzZ = (count-1) / (patternLength/tempPrimeVec);
                if ganzZ==0
                        if (primeVec(count)==0)
                          primeVec(count) = primeIndex;
                          primeIndex=primeIndex+1;
                        end
                else
                        if ((ganzZ+1)/floor((ganzZ+1))==1.0)
                           if (primeVec(count)==0)
                              primeVec(count)   = primeIndex;
                              primeIndex=primeIndex+1;
                          end
                        end
                end
                count=count+1;
        end
end

for i=1:length(mtVec)

        tempPrimeVec = tempPrimeVec*mtVec(i);
        count = 1 ;
        while (count < patternLength+1)
                ganzZ = (count-1)/(patternLength/tempPrimeVec);
                if ganzZ==0
                        if (primeVec(count)==0)
                          primeVec(count)   = primeIndex;
                          primeIndex=primeIndex+1;
                        end
                else
                        if ((ganzZ+1)/floor((ganzZ+1)==1.0)
                                if (primeVec(count)==0)
                                  primeVec (count)  = primeIndex;
                                  primeIndex=primeIndex+1;
                                end
                        end
                end
                count=count+1;
        end
end
outVec = primeVec;
```

FIGURE 8

Pattern 1: meter 4/4

| | | | | | |
|---|---|---|---|---|---|
| Rhythmic level | *** | *** | ** | ** | * |
| Prime index | 1 | 2 | 3 | 4 | 7 |
| velocity | 100 | 150 | 112 | 120 | 68 |

test pattern

1st group 2nd group 3rd group

Pattern 2: meter 4/4

| | | |
|---|---|---|
| Rhythmic level | *** | *** |
| Prime index | 1 | 2 |
| velocity | 120 | 145 |

reference pattern

FIGURE 10

| Instrument | 1 | 2 | 3 | 4 | 5 | 6 | 7 | 8 |
|---|---|---|---|---|---|---|---|---|
| 1 | 110 | 112 | 15 | 0 | 10 | 0 | 0 | 0 |
| 2 | 110 | 112 | | | | | | |
| 3 | 50 | 75 | 0 | 0 | 72 | 12 | | |
| 4 | 20 | 10 | 0 | 0 | 0 | 12 | 10 | 3 |

Primeindex velocity

Querypattern

FIGURE 12A

| Instrument | | | |
|---|---|---|---|
| | 1 | indexe | 1 2 3 5 |
| | 2 | indexe | 1 2 |
| | 3 | indexe | 1 2 5 6 |
| | 4 | indexe | 1 2 6 7 8 |

FIGURE 12B

APPARATUS AND METHOD FOR GENERATING AN ENCODED RHYTHMIC PATTERN

CROSS-REFERENCE TO RELATED APPLICATION

This application is a divisional of U.S. Ser. No. 10/961,957, filed Oct. 08, 2004 now U.S. Pat. No. 7,193,148, which is incorporated herein in its entirety by this reference thereto.

BACKGROUND OF THE INVENTION

1. Field of the Invention

The present invention relates to audio data processing and, in particular, to metadata suitable for identifying an audio piece using a description of the audio piece in the form of rhythmic pattern.

2. Description of Prior Art

Stimulated by the ever-growing availability of musical material to the user via new media and content distribution methods, an increasing need to automatically categorize audio data has emerged. Descriptive information about audio data which is delivered together with the actual content represents one way to facilitate this task immensely. The purpose of so-called metadata ("data about data") is to for example detect the genre of a song, to specify music similarity, to perform music segmentation on the song or to simply recognize a song by scanning a data base for similar metadata. Stated in general, metadata are used to determine a relation between test pieces of music having associated test metadata and one or more reference pieces of music having corresponding reference metadata.

One way to achieve these aims using features that belong to a lower semantic hierarchy order is described in "Content-based-identification of audio material using MPEG-7 low level description", Allamanche, E., Herre, J., Helmuth, O., Proceedings of the second annual symposium on music information retrieval, Bloomington, USA, 2001.

The MPEG-7 standard is an example for a metadata standard which has been published in recent years in order to fulfill requirements raised by the increasing availability of multimedia content and the resulting issue of sorting and retrieving this content. The ISO/IEC MPEG-7 standard takes a very broad approach towards the definition of metadata. Herein, not only hand-annotated textual information can be transported and stored but also more signal specific data that can in most cases be automatically retrieved from the multimedia content itself.

While some people are interested in an algorithm for the automated transcription of rhythmic (percussive) accompaniment in modern day popular music, others try to capture the "rhythmic gist" of a piece of music rather than a precise transcription, in order to allow a more abstract comparison of musical pieces by their dominant rhythmic patterns. Nevertheless, one is not only interested in rhythmic patterns of percussive instruments, which do not have their main focus on playing certain notes but generating a certain rhythm, but also the rhythmic information provided by so-called harmonic sustained instruments such as a piano, a flute, a clarinet, etc. can be of significant importance for the rhythmic gist of a piece of music.

Contrary to low-level tools, which can be extracted directly from the signal itself in a computationally efficient manner, but which carry little meaning for the human listener, the usage of high-level semantic information relates to the human perception of music and is, therefore, more intuitive and more appropriate for the task to model what happens when a human listener recognizes a piece of music or not.

It has been found out that the rhythmic elements of music, determined by the drum and percussive instruments, play an important role especially in contemporary popular music. Therefore, the performance of advanced music retrieval applications will benefit from using mechanisms that allow the search for rhythmic styles, particular rhythmic features or generally rhythmic patterns when finding out a relation between a test rhythmic pattern and one or more reference rhythmic patterns which are, for example, stored in a rhythmic pattern data base.

The first version of MPEG-7 audio (ISO-IEC 15938-4) does not, however, cover high-level features in a significant way. Therefore, the standardization committee agreed to extend this part of the standard. The work contributing high-level tools is currently being assembled in MPEG-7 audio amendment 2 (ISO-IEC 15938-4 AMD2). One of its features is "rhythmicpatternsDS". The internal structure of its representation depends on the underlying rhythmic structure of the considered pattern.

There are several possibilities to obtain a state of the art rhythmic pattern. One way is to start from the time-domain PCM representation of a piece of music such as a file, which is stored on a compact disk, or which is generated by an audio decoder working in accordance with the well-known MP3 algorithm (MPEG 1 layer 3) or advanced audio algorithms such as MPEG 4 AAC. In accordance with this method described in "Further steps towards drum transcription of polyphonic music", Dittmar, C., Uhle, C., Proceedings of the AES 116th Convention, Berlin, Germany, 2004, a classification between un-pitched classic instruments and harmonic-sustained instruments is performed. The detection and classification of percussive events is carried out using a spectrogram-representation of the audio signal. Differentiation and half-way rectification of this spectrogram-representation result in a non-negative difference spectrogram, from which the times of occurrence and the spectral slices related to percussive events are deduced.

Then, the well-known Principle Component Analysis (PCA) is applied. When one obtains principle components, which are subjected to a Non-Negative Independent Component Analysis (NNICA), as described in "Algorithms for non-negative independent component analysis", Plumbley, M., Proceedings of the IEEE Transactions on Neuronal Networks, 14 (3), pages 534-543, 2003, which attempts to optimize a cost function describing the non-negativity of the components.

The spectral characteristics of un-pitched percussive instruments, especially the invariance of a spectrum of different notes compared to pitched instruments allows separation using an un-mixing matrix to obtain spectral profiles, which can be used to extract the spectrogram's amplitude basis, which is also termed as the "amplitude envelopes". This procedure is closely related to the principle of Prior Sub-space Analysis (PSA), as described in "Prior sub-space analysis for drum transcription", Fitzgerald, D., Lawlor, B. and Coyle, E. Proceedings of the $114^{th}$ AES Convention, Amsterdam, Netherlands, 2003.

Then, the extracted components are classified using a set of spectral-based and time-based features. The classification provides two sources of information. Firstly, components should be excluded from the rest of the processing, which are clearly harmonically sustained. Secondly, the remaining dissonant percussive components should be assigned to pre-defined instrument classes. A suitable measure for the distinction of the amplitude envelopes is represented by the percussiveness, which is introduced in "Extraction of drum tracks from polyphone music using independent sub-space analysis", Uhle, C., Dittmar, C., and Sporer, T., Proceedings of the Fourth International Symposium on Independent Component Analysis, Nara, Japan, 2003.

The assignment of spectral profiles to a priori trained classes of percussive instruments is provided by a k-nearest neighbor classifier with spectral profiles of single instruments from a training database. To verify the classification in cases of low reliability or several occurrences of the same instrument, additional features describing the shape of the spectral profilei e.g. centroid, spread and tunes are extracted. Other features are the center frequencies of the most prominent local peaks, their intensities, spreads and skewnesses.

Onsets are detected in the amplitude envelopes using conventional peak picking methods. The intensity of the on-set candidate is estimated from the magnitude of the envelope signal. Onsets with intensities exceeding a predetermined dynamic threshold are accepted. This procedure reduces cross-talk influences of harmonic sustained instruments as well as concurrent percussive instruments.

For extracting drum patterns, the audio signal is segmented into similar and characteristic regions using a self-similarity method initially proposed by Foote, J., "Automatic Audio Segmentation using a Measure of Audio Novelty", Proceeding of the IEEE International Conference on Multimedia and Expo, vol. 1, pages 452-455, 2000. The segmentation is motivated by the assumption that within each region not more than one representative drum pattern occurs, and that the rhythmic features are nearly invariant.

Subsequently, the temporal positions of the events are quantized on a tatum grid. The tatum grid describes a pulse series on the lowest metric level. Tatum period and tatum phase are computed by means of a two-way mismatch error procedure, as described in "Pulse-dependent analysis of percussive music", Gouyon, F., Herrera, P., Cano, P., Proceedings of the AES 22$^{nd}$ International Conference on Virtual, Synthetic and Entertainment Audio, 2002.

Then, the pattern length or bar length is estimated by searching for the prominent periodicity in the quantized score with periods equaling an integer multiple of the bar length. A periodicity function is obtained by calculating a similarity measure between the signal and its time-shifted version. The similarity between the two score representations is calculated as a weighted sum of the number of simultaneously occurring notes and rests in the score. An estimate of the bar length is obtained by comparing the derived periodicity function to a number of so-called metric models, each of them corresponding to a bar length. A metric model is defined here as a vector describing the degree of periodicity per integer multiple of the tatum period, and is illustrated as a number of pulses, where the height of the pulse corresponds to the degree of periodicity. The best match between the periodicity function derived from the input data and predefined metric models is computed by means of their correlation coefficient.

The term tatum period is also related to the term "microtime". The tatum period is the period of a grid, i.e., the tatum grid, which is dimensioned such that each stroke in a bar can be positioned on a grid position. When, for example, one considers a bar having a 4/4 meter, this means that the bar has 4 main strokes. When the bar only has main strokes, this means that the tatum period is the time period between two main strokes. In this case, the microtime, i.e., the metric division of this bar is 1, since one only has main strokes in the bar. When, however, the bar has exactly one additional stroke between two main strokes, the microtime is two and the tatum period is the half of the period between two main strokes. In the 4/4 example, the bar, therefore, has 8 grid positions, while in the first example, the bar only has 4 grid positions.

When there are two strokes between two main strokes, the microtime is 3, and the tatum period is ⅓ of the time period between two main strokes. In this case, the grid describing one bar has 12 grid positions.

The above-described automatic rhythmic pattern extraction method results in a rhythmic pattern as shown in FIG. 2*a*. FIG. 2*a* shows one bar having a meter of 4/4, a microtime equal to 2 and a resulting size or pattern length of 4 by 2 equals 8.

A machine-readable description of this bar would result in line 20*a* showing a grid position from one to eight, and line 20*b* showing velocity values for each grid position. For the purpose of better understanding, FIG. 2*a* also includes a line 20*c* showing the main strokes 1, 2, 3, and 4 corresponding to the 4/4 meter and showing additional strokes 1+, 2+, 3+, and 4+ at grid positions 2, 4, 6, and 8.

As it is known in the art, the term "velocity" indicates an intensity value of an instrument at a certain grid position or main stroke or additional stroke (part of the bar), wherein, in the present example, a high velocity value indicates a high sound level, while a low velocity value indicates a low sound level. It is clear that the term velocity can therefore, be attributed to harmonic-sustained instruments as well as un-pitched instruments (drum or percussion). In the case of a drum, the term "velocity" would describe a measure of the velocity, a drumstick has, when hitting the drum.

In the FIG. 2*a* example, it becomes clear that the drum is hit at grid positions 1, 3, 5, 6, 7 with different velocities while the drummer does not hit or kick the drum at grid positions 2, 4, 8.

It should be noted here that the FIG. 2*a* prior art rhythmic pattern cannot only be obtained by an automatic drum description algorithm as described above, but is also similar to the well-known MIDI description of instruments as used for music synthesizers such as electronic keyboards, etc.

The FIG. 2*a* rhythmic pattern uniquely describes the rhythmic situation of an instrument. This rhythmic pattern is in-line with the way of playing the rhythmic pattern, i.e., a note to be played later in time is positioned after a note to be played earlier in time. This also becomes clear from the grid position index starting at a low value (1) and, after having monotonically increased, ending at a high value (8).

Unfortunately, this rhythmic pattern, although uniquely and optimally giving information to a player of the bar is not suited for an efficient data base retrieval. This is due to the fact that the pattern is quite long, and, therefore memory-consuming. Additionally and importantly, the important and not so important information in the rhythmic pattern of FIG. 2*a* is very well distributed over the pattern.

In the case of a 4/4 meter, it is clear that the highest importance in the beats, which are parts 1 and 3 of the bar at grid positions 1 and 5, while the second-order importance is in the so-called "off-beats" which occur at parts of the bar 2 and 4 at grid positions 3 and 7. The third-class importance is in the additional strokes between the beats/off-beats, i.e., at grid positions 2, 4, 6, and 8.

A search engine in a database using test and reference rhythmic patterns as shown in FIG. 2*a*, therefore has to compare the complete test rhythmic pattern to the complete reference rhythmic patterns to finally find out a relation between the test rhythmic pattern and the reference rhythmic patterns. When one bears in mind that the rhythmic pattern in FIG. 2*a* only describes a single bar of a piece of music, which can, for example, have 2000 bars, and when one bears in mind that the number of pieces of music in a reference data base is to be as large as possible to cover as many as possible pieces of music, one can see that the size of the data base storage can be explode to a value of the number of pieces of music multiplied by the number of bars per piece of music multiplied by the number of bits for representing a single bar rhythmic pattern.

While the storage might not be a large issue for personal computers, it can raise the size and costs of portable music processors such as music players. Additionally, the size of the rhythmic pattern in FIG. 2*a* becomes even more important when one tries to have a reasonable time frame for the search engine correlating a test rhythmic pattern to the reference rhythmic patterns. In case of high-end work stations having nearly unlimited computational resources, the FIG. 2*a* rhythmic pattern might not be too problematic. The situation, however, becomes critical, when one has limited computational resources such as in personal computers or once again, portable players, whose price has to be significantly lower than the price of a personal computer, when such an audio retrieval system is to survive on the highly competitive marketplace.

SUMMARY OF THE INVENTION

It is the object of the present invention to provide an efficient concept for processing audio patterns.

In accordance with a first aspect, the invention provides an apparatus for generating an encoded rhythmic pattern from a rhythmic pattern, the rhythmic pattern having a set of velocity values, each velocity value being associated with a grid position from a plurality of grid positions, the plurality of grid positions further having grid positions at two different rhythmic levels, a grid position at a first rhythmic level having a higher significance than the grid position at the second rhythmic level, having: a processor for determining a grid position at the first rhythmic level and for determining a grid position at the second rhythmic level; and a sorter for sorting the velocity values, so that the velocity values associated with grid positions at the first rhythmic level form a first group and that velocity values associated with grid positions at the second rhythmic level form a second group and that the first group and the second group are in sequence to each other to obtain the encoded rhythmic pattern.

In accordance with a second aspect, the invention provides a method of generating an encoded rhythmic pattern from a rhythmic pattern, the rhythmic pattern having a set of velocity values, each velocity value being associated with a grid position from a plurality of grid positions, the plurality of grid positions further having grid positions at two different rhythmic levels, a grid position at a first rhythmic level having a higher significance than the grid position at the second rhythmic level, the method including the following steps: determining a grid position at the first rhythmic level and for determining a grid position at the second rhythmic level; and sorting the velocity values, so that the velocity values associated with grid positions at the first rhythmic level form a first group and that velocity values associated with grid positions at the second rhythmic level form a second group and that the first group and the second group are in sequence to each other to obtain the encoded rhythmic pattern.

In accordance with a third aspect, the invention provides an encoded rhythmic pattern having velocity values associated with grid positions at a first rhythmic level in a first group and having velocity values associated with grid positions at a second rhythmic level in a second group, wherein the first group and the second group are in sequence to each other.

In accordance with a fourth aspect, the invention provides an apparatus for determining a relation between a test piece of music and a reference piece of music, having: an input interface for providing an encoded rhythmic pattern of the test piece of music, the encoded rhythmic pattern having velocity values associated with grid positions at a first rhythmic level in a first group and having velocity values associated with grid positions at a second rhythmic level in a second group, wherein the first group and the second group are in sequence to each other; a database having an encoded rhythmic pattern for at least one reference piece of music; a search engine for comparing the encoded rhythmic pattern of the test piece of music to the encoded rhythmic pattern of the reference piece of music, the search engine being operative to correlate the first group of velocity values of the encoded test rhythmic pattern to a first group of velocity values of the encoded rhythmic pattern for the reference piece of music, before comparing further velocity values; and an output interface for indicating the relation between the test piece of music and the reference piece of music based on the correlation result.

In accordance with a fifth aspect, the invention provides a method of determining a relation between a test piece of music and a reference piece of music, the method comprising: providing an encoded rhythmic pattern of the test piece of music, the encoded rhythmic pattern having velocity values associated with grid positions at a first rhythmic level in a first group and having velocity values associated with grid positions at a second rhythmic level in a second group, wherein the first group and the second group are in sequence to each other and an encoded rhythmic pattern for at least one reference piece of music; comparing the encoded rhythmic pattern of the test piece of music to the encoded rhythmic pattern of the reference piece of music, the search engine being operative to correlate the first group of velocity values of the encoded test rhythmic pattern to a first group of velocity values of the encoded rhythmic pattern for the reference piece of music, before comparing further velocity values; and indicating the relation between the test piece of music and the reference piece of music based on the correlation result.

In accordance with a sixth aspect, the invention provides an apparatus for decoding an encoded rhythmic pattern, which has been encoded by the method of generating an encoded rhythmic pattern from a rhythmic pattern, the rhythmic pattern having a set of velocity values, each velocity value being associated with a grid position from a plurality of grid positions, the plurality of grid positions further having grid positions at two different rhythmic levels, a grid position at a first rhythmic level having a higher significance than the grid position at the second rhythmic level, the method including the following steps: determining a grid position at the first rhythmic level and for determining a grid position at the second rhythmic level; and sorting the velocity values, so that the velocity values associated with grid positions at the first rhythmic level form a first group and that velocity values associated with grid positions at the second rhythmic level form a second group and that the first group and the second group are in sequence to each other to obtain the encoded rhythmic pattern, to obtain a decoded rhythmic pattern.

In accordance with a seventh aspect, the invention provides a method of decoding an encoded rhythmic pattern, which has been encoded by the method of generating an encoded rhythmic pattern from a rhythmic pattern, the rhythmic pattern having a set of velocity values, each velocity value being associated with a grid position from a plurality of grid positions, the plurality of grid positions further having grid positions at two different rhythmic levels, a grid position at a first rhythmic level having a higher significance than the grid position at the second rhythmic level, the method including the following steps: determining a grid position at the first rhythmic level and for determining a grid position at the second rhythmic level; and sorting the velocity values, so that the velocity values associated with grid positions at the first rhythmic level form a first group and that velocity values associated with grid positions at the second rhythmic level form a second group and that the first group and the second group are in sequence to each other to obtain the encoded rhythmic pattern, to obtain a decoded rhythmic pattern.

In accordance with an eighth aspect, the invention provides a computer-program for performing a method of generating an encoded rhythmic pattern from a rhythmic pattern, the rhythmic pattern having a set of velocity values, each velocity value being associated with a grid position from a plurality of grid positions, the plurality of grid positions further having grid positions at two different rhythmic levels, a grid position at a first rhythmic level having a higher significance than the grid position at the second rhythmic level, the method including the following steps: determining a grid position at the first rhythmic level and for determining a grid position at the second rhythmic level; and sorting the velocity values, so that the velocity values associated with grid positions at the first rhythmic level form a first group and that velocity values associated with grid positions at the second rhythmic level form a second group and that the first group and the second group are in sequence to each other to obtain the encoded rhythmic pattern, when the computer-program runs on a computer.

The present invention is based on the finding that an efficient representation of a rhythmic pattern is obtained by encoding a normal rhythmic pattern so that the encoded rhythmic pattern has a first group of velocity values followed by a second group of velocity values, the first group of velocity values being associated with grid positions at a first rhythmic level, and the second group of velocity values being associated with grid positions at a second rhythmic level. In this encoded rhythmic pattern, velocity values associated with grid positions at the same rhythmic level are in one group, which results in the fact that the encoded rhythmic pattern is a rhythmic pattern, which is not ordered in accordance with the correct time sequence for playing the bar associated with the rhythmic pattern, but is sorted in accordance with the importance of grid positions in the bar.

This representation of a piece of music allows a data base search engine to process the encoded rhythmic patterns sequentially i.e., to process the first group of velocity values having a higher importance for the rhythmic gist of the piece of music before processing the second group and further groups of velocity values, which have lower importance for the rhythmic gist of a piece of music. Stated in other words, processing of the first group of the velocity values will result in a recognition in the data base search engine that several reference rhythmic patterns, which are not in line with the test rhythmic pattern with respect to their first groups of velocity values can be eliminated from further consideration, i.e., when velocity values of lower rhythmic levels, i.e., velocity values having a lower importance on the rhythmic gist of a piece of music are processed by the search engine.

The present invention therefore does not contribute maximum attention to the magnitude of the velocity value, i.e., the loudness or intensity, but attributes maximum importance to the rhythmic level, to which a certain velocity value belongs to. This is in line with the human perception, which tries to find a rhythm in a piece of music or which feels a rhythm in the piece of music irrespective of the fact, whether the beats, which make the rhythm are very loud or not. Stated in other words, it is not the loudness or intensity or, generally stated, the velocity of a note or of notes in a sequence of notes, which make a listener to move his hands, feet or his body in a rhythmic way, but it is the importance of a note in a rhythmic frame, which determines the rhythm. Naturally, the velocity value is not ignored totally. On the other hand, a rhythmic pattern, in which the strokes between beats are important, also exists in case of so-called "syncopes", i.e., in a situation in which, for certain stylish reasons, the additional strokes between the beats and the off-beats are louder than the beats or off-beats themselves.

In the preferred embodiment, the inventive encoded rhythmic pattern it has also a very storage-efficient appearance, since all grid positions, irrespective of their rhythmic levels are completely eliminated when there velocity values are lower than a certain threshold, which is for example, the lowest velocity quantization level or velocity quantization step size. The grid positions to be eliminated in this case are, therefore, the grid positions having a value of e.g. zero in a quantized rhythmic pattern.

In a preferred embodiment, the determination which grid positions are more important than other grid positions, i.e., which grid positions are to be attributed to the first group, and which grid positions are to be attributed in the second group is performed based on a prime decomposition of the nominator of the meter fraction, which is given by the term (meter nominator)/(meter denominator). It has been found out that the hierarchical grid position/rhythmic level determination is automatically performed by using the prime numbers resulting from a prime decomposition of the nominator. In accordance with the present invention, the grid position index is replaced by a prime index derived by using a prime factor decomposition of the meter nominator. The prime index is determined such that higher importance bit positions have lower prime index values while lower-importance grid positions have higher prime index values.

The present invention is advantageous in that it provides a compact representation of a rhythmic pattern, which can also be automatically extracted from an audio signal or consists of excerpts taken from an existing music notation as well. Based on this compact representation, which is constructed in accordance with the importance of a velocity value to a rhythmic impression rather than a time sequence of velocity values or even a magnitude of velocity values, an efficient comparison of patterns such as for classification purposes can be performed with minimum memory for the search engine on the one hand and minimum computational resources for the search engine on the other hand. A particular application is the field of music content retrieval in particular with temporary popular music, in which the rhythmic information is characteristic for a piece of music and, therefore, provides a characteristic fingerprint of this piece of music.

Additionally, the inventive encoded rhythmic pattern allows settings of several grades in resolution such as rhythmic hierarchies, rhythmic levels based on the velocity value resorting, which is especially suitable for further classification or matching of rhythmic patterns.

In the following, preferred embodiments of the present invention are described with respect to the accompanying drawings, in which:

FIG. 1 shows a preferred embodiment of the inventive concept for generating an encoded rhythmic pattern;

FIG. 2*a* illustrates a prior art rhythmic pattern;

FIG. 2*b* illustrates an output of the processor of FIG. 1;

FIG. 2*c* illustrates an output of the zero eliminator in FIG. 1;

FIG. 2*d* illustrates an output of the sorter of FIG. 1;

FIG. 3*a* illustrates an output of the processor for example of a music piece having a ternary feeling;

FIG. 3*b* illustrates an output of the zero eliminator for the FIG. 3*a l example;*

FIG. 3*c* illustrates an output of the sorter for the FIG. 3*a l example;*

FIG. 4*a* illustrates an MPEG-7 conform description of the audio pattern data syntax;

FIG. 4*b* illustrates the semantics for the FIG. 4*a* example;

FIG. 5*a* illustrates an MPEG-7 conform example of the audio rhythmic pattern syntax element;

FIG. 5*b* illustrates the semantics for the FIG. 5*a* embodiment;

FIG. 7 illustrates a preferred method embodied by the processor based on prime factorizations of the nominator of the meter and the microtime;

FIG. 8 illustrates another preferred method embodied by the processor based on prime factor decompositions of the nominator of the meter and the microtime;

FIG. 10 illustrates an encoded test rhythmic pattern and an encoded reference rhythmic pattern used in the apparatus of FIG. 9;

FIG. 12*a* illustrates a query pattern before zero elimination for a plurality of instruments;

FIG. 12*b* illustrates a query pattern after zero elimination for several instruments.

The inventive encoded rhythmic pattern is suitable for a flexible syntax having a semantic information for an underlying piece of music so that a maximum scope of musical styles and a maximum scope of rhythmic complexity can be incorporated. Although the subsequent description is related to an encoded rhythmic pattern describing a single bar of a piece of music, this bar as represented in the encoded rhythmic pattern can relate to more bars of a piece of music as well. In this case, the encoded rhythmic pattern is the result of several rhythmic raw patterns of the same meter, which have been combined using any kind of statistic methods such as forming an arithmetic average value or a geometric average value or a median value for each grid position. This means that, for example, for the first grid position, one would add all velocity values of bit position one of the raw rhythmic patterns, followed by dividing the result by the number of raw rhythmic patterns, so that an arithmetic average value is obtained. Then, it is highly probable that, for each bit position a certain average velocity value is obtained. To achieve a more compact representation, a quantization of the resulting average velocity values is performed, which is based on a non-linear or linear quantizer having a certain lowest-level quantization step size, which results in the fact that several quite small average velocity values are quantized to zero so that, after zero elimination, an even more compact representation of the encoded rhythmic pattern is obtained.

Figure 1:
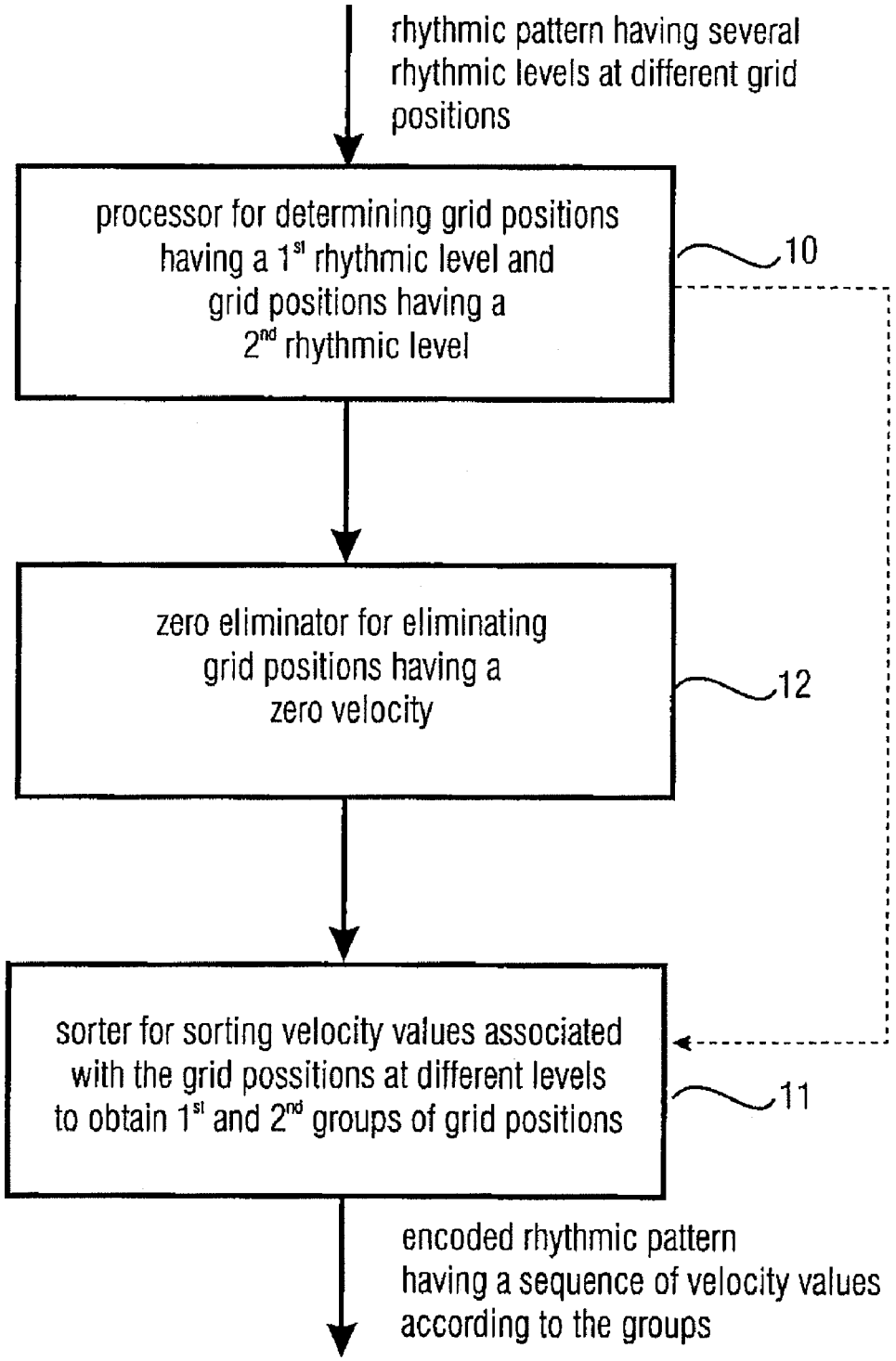

FIG. 1 illustrates an inventive apparatus for generating an encoded rhythmic pattern from a rhythmic pattern, which includes the sequence of velocity values associated with grid positions, wherein the rhythmic pattern input into the inventive apparatus of FIG. 1 can exist in a time-wise manner or in a magnitude-wise manner with respect to velocity or in any other manner.

The rhythmic pattern input into the FIG. 1 apparatus, therefore, has a set of velocity values, each velocity value being associated with a grid position from a plurality of grid positions, the plurality of grid positions further having grid positions at at least two different rhythmic levels, a grid position at the first rhythmic level having a higher significance than a grid position at a second rhythmic level. Such an (uncoded) rhythmic pattern is input into a processor 10 for determining grid positions having a first rhythmic level and for determining grid positions having a second rhythmic level. Processor 10 outputs an illustrative representation as shown in FIG. 2*b*. The main purpose of the processor is to generate line 21, which indicates the rhythmic level for each grid position. As outlined above with respect to FIG. 2*a*, the beats at grid positions 1 and 5, i.e., parts 1 and 3 of the bar have the highest rhythmic level, which is illustrated by 3 stars in FIG. 2*b*. The off-beats at grid positions 3 and 7 or parts 2 and 4 of the bar have the second rhythmic level, which is indicated by 2 stars in FIG. 2*b*. Finally, the grid positions 2, 4, 6, 8 all have the third rhythmic level, which is indicated by a single star in FIG. 2*b*.

In a preferred embodiment of the present invention, the processor 10 is also operative to generate a prime index for each grid position as is indicated by line 22 in FIG. 2*b*. The prime index includes a value for each grid position, while grid positions belonging to the highest rhythmic level have low indices 1, 2, the grid positions belonging to the second rhythmic level have higher indices 3 and 4, and the grid positions at the third rhythmic level have even higher indices 5, 6, 7, and 8.

The inventive prime index determination as illustrated in FIGS. 7 and 8 results in a prime index, which has a two-fold meaning. On the one hand, a prime index for a velocity value at a bit position having a higher rhythmic level is lower than the prime index for a velocity value at the grid position having a lower rhythmic level. The second characteristic of the prime index is that, when there are several velocity values for grid positions at the same rhythmic level, the order of the prime index also reflects the time sequence of the velocity values. This means that the velocity value for grid position 1 receives a lower prime index than the velocity value for the grid position 5 having the same rhythmic level. This velocity value, however, receives a higher prime index, since grid position 5 appears after grid position 1, when the rhythmic pattern of FIG. 2*b* is to be played.

The inventive processor does not have to generate the prime index in one embodiment. In this embodiment, the processor 10 does not even have to change anything at the description of FIG. 2*a*, as long as the processor 10 provides information on the rhythmic level to a sorter 11 for sorting the velocity values associated with the grid position at different levels to obtain first and second groups of grid positions. A sorter is operative for sorting the velocity values so that the velocity values associated with the grid positions at the first rhythmic level form a first group and that the velocity values associated with the grid positions at the second rhythmic levels form a second group, and that the first and the second group are in sequence to each other so that at an output of the sorter 11, the inventive encoded rhythmic pattern having a sequence of velocity values according to the groups is obtained.

In the preferred embodiment, however, the processor 10 is operative to generate the prime index 22 in FIG. 2*b*, which replaces the grid position 20*a* in FIG. 2*a* as can be seen in FIG. 2*c* and in FIG. 2*d*.

In a preferred embodiment of the present invention, the inventive apparatus further comprises a zero eliminator 12 for eliminating grid positions having a zero velocity. As has been outlined above, the "zero" velocity can be a velocity having indeed a value of zero, or can be a velocity which is below a minimum threshold, which can correspond to a quantization step size for the lowest quantization bin.

The zero eliminator 12 is operative to eliminate grid positions having a zero velocity. In the FIG. 2*b* example, the zero eliminator would eliminate positions 2, 4, 8 from further consideration. In the case in which the zero eliminator is positioned after the processor 10, but before the sorter 11, the zero eliminator 12 would output the processed rhythmic pattern as shown in FIG. 2*c*, which only has the prime index 22 and the velocity values 20*b*. It has to be noted here that the rhythmic level 21 is only shown for illustration purposes, but would not appear in the processingof FIG. 1, since the prime index 22 includes the information on the rhythmic level and, in addition, includes information on the time sequence of velocity values, as has been outlined above.

The FIG. 2*c* representation is input into the sorter 11, so that a representation given in FIG. 2*d* is obtained. The sorter 11 includes a simple sorting algorithm, which outputs an encoded rhythmic pattern, in which velocity values having lower prime index values are positioned more to the start of the encoded rhythmic pattern, while velocity values having higher prime index values are positioned more to the end of the encoded rhythmic pattern. Referring to FIG. 2*d*, velocity values for the prime index 1 and the prime index 2 form the first group, while velocity values for the prime index 3 and the prime index 4 form the second group, while the third group having the prime index 7 only has a single velocity value.

The zero eliminator 12 can also be positioned before the processor 10, or after the sorter 11. Positioning of the zero eliminator 12 before the processor 10 would result in a slightly better computational performance, since the processor 10 would not have to consider zero-valued grid positions when determining the rhythmic levels for the positions. On the other hand, the preferred positioning of the zero eliminator 12 between the processor 10 and the sorter 11 allows the application of one of the preferred algorithms in FIG. 7 or FIG. 8, which rely on the time sequence of the un-coded rhythmic pattern. Finally, the zero eliminator 12 can also be positioned after the sorter 11. Since sorting algorithms exist, which do not necessarily need a full sequence of integers, the zero eliminator 12 is positioned before the sorter 11.

FIGS. 3*a* to 3*c* show another example, also having a 4/4-meter. In contrast to the FIG. 2*a* to 2*d* embodiment, the microtime in FIG. 3*a* to FIG. 3*c* is 3, which results in a higher pattern length or size of the rhythmic pattern in FIG. 3*a* and which also results in the fact that the music piece has a kind of a ternary feeling. FIG. 3*a* shows the output of the processor, since the rhythmic level is marked. Nevertheless, the FIG. 3*a* embodiment still includes the grid position index, which is the "equivalent element index" in FIG. 3*a*.

In FIG. 3*b*, the output after the zero eliminator 12 in FIG. 1 is shown, i.e., a situation in which all velocity values equal to zero and the corresponding prime indexes (elements) are deleted.

FIG. 3*c* finally shows the encoded rhythmic pattern as output by the sorter 11 having, again, three groups, wherein the first group has two elements, the second group has two elements and the third group has four elements. The FIG. 3*c* embodiment is remarkable in that both members of the first group have lower velocity values than both members of the second group, while the velocity values of the third group are all lower than the velocity values of the first and second groups.

FIG. 4*a* shows an MPEG-7 conformant description of the audio pattern description syntax (DS). The explanation of the elements in FIG. 4*a*, i.e., the semantics, is shown in FIG. 4*b*. The audio pattern data syntax includes information on the meter of the corresponding bar of the piece of music and can be included in the MPEG-7 syntax. Additionally, the FIG. 4*a* embodiment includes information on the tempo of the drum pattern in beats per minute (BPM). Additionally, emphasis is drawn to line 40 in FIG. 4*a*, which has the element name "pattern", wherein a further description of the pattern 40 is given in subsequent FIGS. 5*a* and 5*b*. Additionally, the FIG. 4*a* description includes an element name entitled "barNum", which indicates the position of the bar or the rhythmic pattern in the piece of music. In case of a bar-wise description, the barNum for the first bar would be one, the barNum for the tenth bar would be ten and the barNum for the five hundredth bar would be five hundred, for example. In case of averaging rhythmic pattern types, in which, for example, ten subsequent patterns are combined to provide an average pattern, the barNum for the first ten bars would be one, the barNum for the bars eleven to twenty would be two, etc.

FIG. 5*a* illustrates a more detailed representation of an audio rhythmic pattern. In addition to the bar Num information, the FIG. 5*a* embodiment preferably includes an instrument ID field. In accordance with the preferred embodiment, the FIG. 5*a* description further includes the prime index vector, which is, for example, in line 22 in FIG. 2*c* and a velocity vector, which is in line 23 of FIG. 2*c* or FIG. 2*d*. In addition to this information, the FIG. 5*a* embodiment also includes the microtime and tempo in beats per minute. It is unnecessary to include the tempo in the FIG. 5*a* description as well as in the FIG. 4*a* description. Additionally, the FIG. 4*a* description includes information on the meter, from which the prime factor decomposition is derived.

Figure 6:
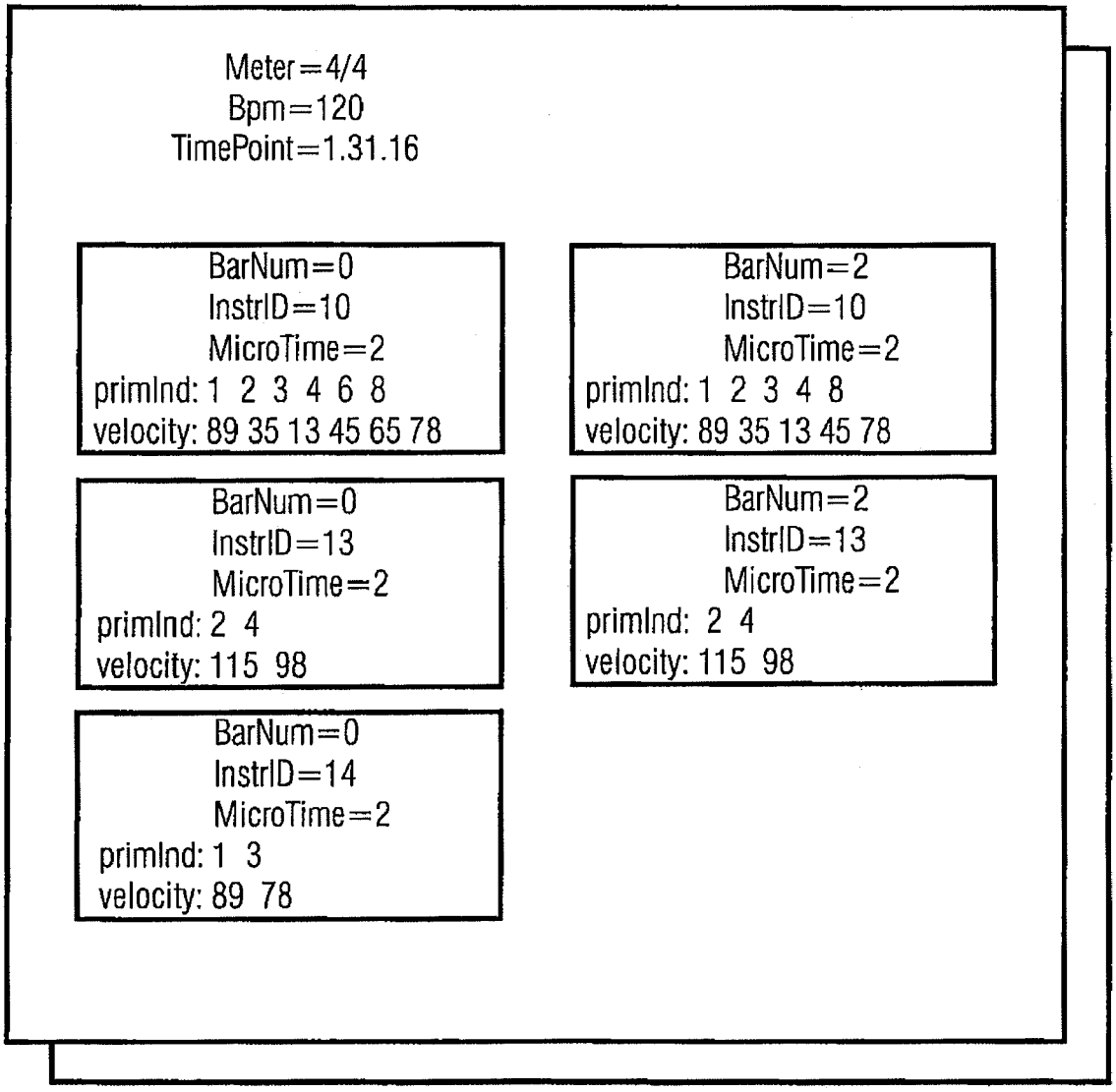
FIG. 6 illustrates an example instance of audio rhythmic pattern type metadata for a plurality of instruments.

FIG. 6 illustrates an example for several instruments, i.e., for instruments having instrument IDs 10, 13 and 14. Additionally, as has been outlined above with respect to FIG. 5*a*, the FIG. 6 embodiment also includes a bar Num field as well as the microtime, naturally the prime index vector and the velocity vector. The FIG. 6 example also illustrates a similar description for the next bar having bar Num 2, i.e., for the bar following the bar having the bar Num equal to zero.

It further becomes clear from FIG. 6 that the bar indicated by bar Num does not have the instrument with the instrument ID equal to 14, but only has instruments identified by instrument identifications 10 and 13. Additionally, it becomes clear that instrument ID 13 has the same prime index vector for both bars, while instrument ID=10 has a velocity value different from zero at prime index 6 in the earlier bar, while no such velocity value at the prime index 6 is included in the later bar.

FIG. 7 illustrates a preferred implementation of the inventive processor 10 for determining the grid positions having several rhythmic levels. In particular, the processor 10 is operative to calculate each prime index of a rhythmical pattern by using a prime factorization of the nominator of the meter, which is, in the FIG. 2 example, a vector having only elements (2, 2).

In a further step, also a prime factorization of the microtime is performed, which results in the vector having a single component of two. Then, an iterative calculation of the prime indices for the grid position is performed. In an outer iteration loop, a first iteration index i is incremented until the length of the prime factorization vector, i.e., until two in the present embodiment. In an inner iteration loop, an iteration parameter j is iterated from one to the number of components in the prime factorization vector of the microtime. In the present embodiment, this value is equal to one, so that the inner iteration loop is only processed for a first time, but is not processed for a second time. A certain grid position is then determined by the variable "count". It is then determined as to whether the grid-position defined by count is not yet assigned. When the grid position determined by count is not yet assigned, it receives a prime index value determined by the current value of the prime index parameter (primeIndex) in this way, the primeIndex vector primevec is iteratively filled up.

After the iterations for i and j have been processed, essentially the same procedure is performed for the microtime prime factorization vector, as is illustrated in FIG. 7.

When the FIG. 7 algorithm is completely processed, each grid position has a certain prime index value, as illustrated in the FIG. 2 and FIG. 3 embodiments. The vector primevec is, therefore, completed.

An alternative embodiment is shown in FIG. 8, which receives, as an input, the prime index vector nomvec, which is the vector having the prime factors of the nominator of the meter. Additionally, the embodiment in FIG. 8 also receives the microtime prime index vector mtVec.

The first iterative processing step is then performed using the prime factorization vector of the nominator of the meter, which is followed by a second iteration process determined by the prime factorization vector of the microtime. The function entitled "Prod" outputs the product of all components in a vector.

Alternate embodiments for calculating the prime index values for the associated velocity values can be devised. When such algorithms are based on a prime vector decomposition of the meter of the bar and, preferably, also on the prime factorization of the microtime, one not only receives an encoded rhythmic pattern, in which velocities having the same rhythmic levels are sorted, but in which also the time relation between velocity values having the same rhythmic level is kept.

Generally, the inventive encoded rhythmic pattern is based on a non-linear indexing of the velocity values with the help of the prime index vector. The prime index vector indicates the rhythmic significance (rhythmic level) within the pattern. In general, velocity values that occur on the beat will be indicated by a prime index with a lower integer value than velocity values occurring between two beats (off-beat). Depending on meter and microtime, different numbers of rhythmic hierarchies will result.

Figure 9:
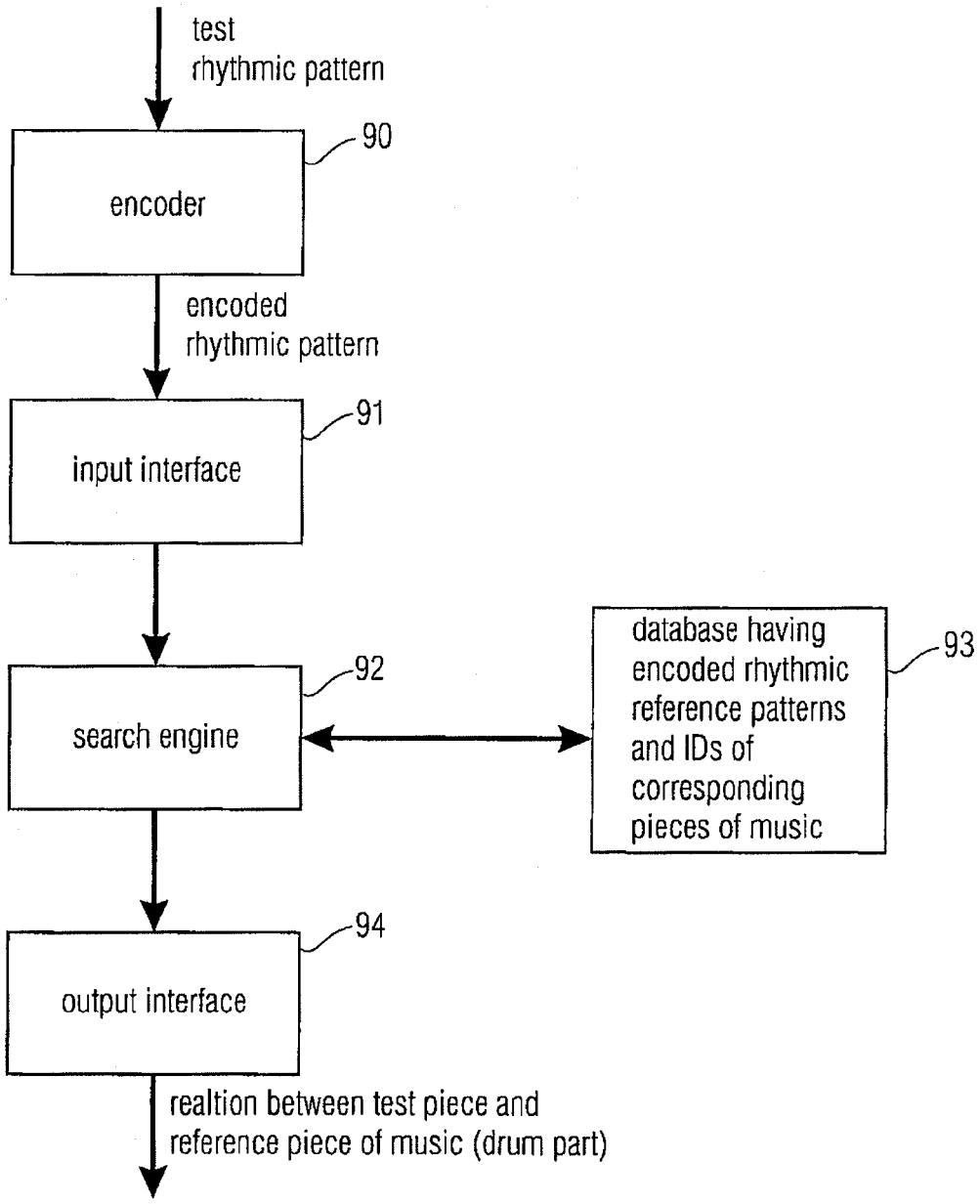
FIG. 9 illustrates a block diagram of an inventive apparatus for determining a relation between a test piece of music and a reference piece of music.

FIG. 9 illustrates a preferred embodiment of an apparatus for determining a relation between a test piece of music and a reference piece of music. To this end, a test piece of music is processed to obtain a test rhythmic pattern, which is input into an encoder 90 to obtain the encoded rhythmic pattern, such as shown in FIGS. 2*d* or 3*c*. In this regard, the encoder 90 is structured as shown in FIG. 1 and as has been described above.

The inventive apparatus further includes an input interface 91 for providing an encoded rhythmic pattern of the test piece of music. This encoded rhythmic pattern is input into a search engine 92 for correlating the encoded rhythmic pattern of the test piece of music to an encoded rhythmic pattern included in database 93. The correlation between the encoded rhythmic patterns is performed such that the first group of velocity values of the test rhythmic pattern is compared to the first group of the rhythmic values of the reference rhythmic pattern before the comparison is continued for the second and further groups. Each group can have only a single group member or more than one or even more than two group members, as has been described above with respect to FIGS. 2*d* and 2*c*. The search engine 92 is operative to provide a correlation result to an output interface 94 for indicating the relation between the test piece of music and the reference piece of music based on the correlation result. Depending on the certain application, the database will include varying numbers of reference pieces of music. When the task of the FIG. 9 system is to simply find out as to whether a certain test rhythmic pattern corresponds to a single reference rhythmic pattern, i.e., when the only information to be obtained by the database is to find out as to whether a test piece of music corresponds to only to a single piece of music and is different from all other pieces of music, the storage of a single encoded rhythmic pattern in the "database" will be sufficient.

When one has to perform a genre determination, a sample rhythmic pattern typical for each genre will be included in the database 93.

When, however, one has to fully identify a test piece from which the test rhythmic pattern is derived, one will have to store many encoded reference patterns from many different music pieces in the database to perform a useful music identification process.

The database 93 does not have to include the whole reference piece of music from which the encoded rhythmic pattern under consideration is derived. Preferably, the database 93 only includes an identification of the corresponding piece of music which, for example, can be used by another database, from which the user can retrieve the final piece of music, which is identified by the output interface 94.

As has been outlined above, the relation to be determined by the output interface 94 therefore is a statement that the test piece of music is equal to the (single) reference piece of music or not, that the test piece of music belongs to a certain music genre, that the test piece of music is similar to one reference piece of music from several reference pieces of music (qualitative statement) or that the reference piece of music is equal to one or several pieces of music with certain matching degrees (quantitative statement).

FIG. 10 shows the situation in which two encoded rhythmic patterns having the same meter (4/4) are compared to each other. In the FIG. 10 embodiment, the zero eliminator was active, so that both rhythmic patterns have different lengths. The search engine 92 of FIG. 9 only has to compare the first and second prime index factor components. Thus, only the number of elements of the shorter representation is taken into account. Since the patterns are sorted, so that more important grid positions come first and less important grid positions come later, the comparison of only the number of elements of the shorter representation is sufficient for obtaining the useful comparison result. In the FIG. 10 embodiment, two steps have already been performed, which are illustrated by reference to FIG. 11. First of all, a meter matching 110 has been performed in the database 93, so that only encoded rhythmic patterns, which are based on the same meter, are considered for comparison purposes. Therefore, all encoded Rhythmic reference patterns having a meter different from 4/4 are deleted from further consideration by step 110. In a later step 111, the functionality of the zero eliminator 12 from FIG. 1 is advantageously used. In particular, all reference patterns are deleted from further consideration, which have zero values in the first group, when the test pattern does not have a zero value in the first group at the same grid position. In other words, this means that all reference patterns are deleted from further consideration in the search, which have a prime index vector, whose two or three first prime index vector components do not completely match. This will result in a great number of patterns, which has been sorted out at a very early stage of comparing. However, since the first two or three prime index values, i.e., the lowest prime index values indicate the most important velocity values, such a sorting-out of reference patterns based on comparing zero values in the first group will not incur any danger of sorting-out potential matches too early.

Figure 11:
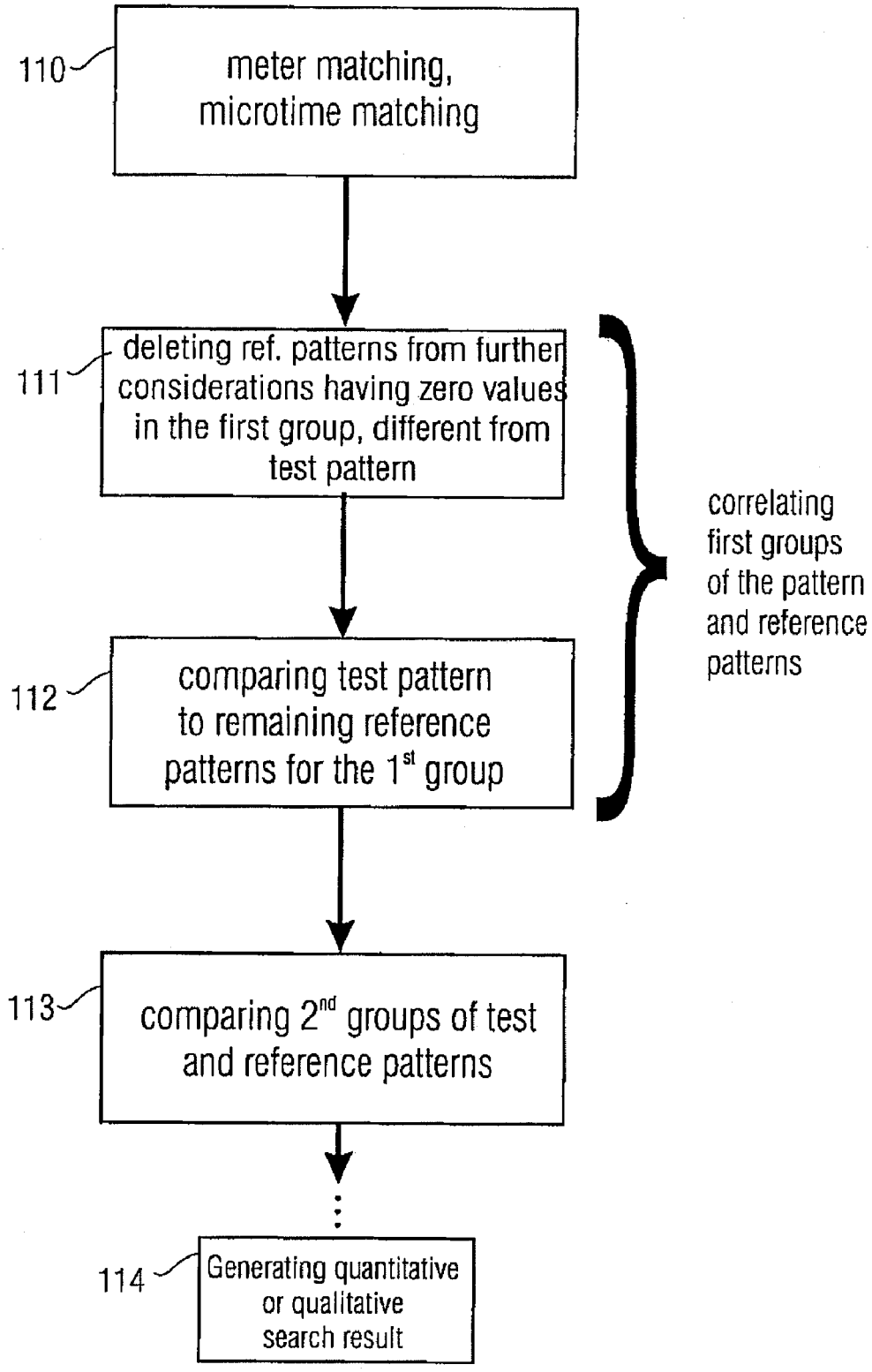
FIG. 11 illustrates a preferred method embodied by the search engine of FIG. 9.

After sorting-out in step 111, the step of comparing is performed so that the best candidates from the remaining reference patterns are determined, as indicated by step 112 in FIG. 11.

Based on these remaining candidates, the step of comparing 113 of this encoded test rhythmic pattern and the corresponding second groups of the reference rhythmic patterns is performed, wherein this procedure can be repeated until all groups have been processed. Then, at the end of the process, the search engine 92 will generate a quantitative or qualitative search result 114.

It becomes clear from the above that the inventive encoded rhythmic pattern allows to perform a sequential database search, such that the first component of the encoded test rhythmic pattern is compared to a first component of an encoded reference rhythmic pattern, so that after each velocity value, a lot of reference patterns can be cancelled, so that one never has to perform simultaneously comparing many velocity values from the test pattern to many velocity values to the reference pattern. This sequential processing in the search engine is made possible by the sorting of the velocity values in accordance with their importance to the rhythmic gist of a piece of music.

FIGS. 12*a* and 12*b* illustrate the situation having a query pattern, which not only consists of a single encoded rhythmic pattern for a single instrument, but which includes several encoded rhythmic patterns from several instruments. In the FIG. 12*a* embodiment, the encoded rhythmic patterns for the instruments have already been re-expanded, so that the functionality of the zero eliminator 12 from FIG. 1 is cancelled. This results in the situation of FIG. 12*a*, in which a run of zeros at the end of the pattern, i.e., from prime index 3 to prime index 8 of the second instrument has not been re-expanded. This function has to take place until the highest prime index from all music instruments is reached. In the FIG. 12*a* embodiment, the highest prime index is given by the instrument having the instrument ID 4.

FIG. 12*a*, therefore, shows an expanded, but ordered representation of the rhythmic patterns in accordance with the order of the prime index, wherein the matrix of FIG. 12*a* is obtained for more than one instrument. In this case, one only has to search the field of a reference pattern in the database 93 in which the velocity is not equal to zero. It becomes clear from FIG. 12*b* that one only has to search the fields shown in FIG. 12*b* in the database 93 and one can fully ignore the other fields. This reduces the search overhead in a database, too.

The inventive concept of encoded rhythmic patterns allows describing rhythmical pattern information in a very flexible and general way. Preferably, the microtime is defined as an element within the audio rhythmic pattern type. In addition, the description of audio rhythmic pattern types is expanded to the representation of several consecutive rhythmic patterns and an arbitrary number of rhythmic patterns that occur in parallel at similar time instances. Thus, a very flexible representation of rhythmic patterns is made possible by the inventive rhythmic pattern encoding.

A quantization of the velocity values to seven loudness states as used in classic music notation (pianissimo possible ppp . . . fortefortissimo fff) can be used for being in conformance with classical music notation, but leads to loss of information, for example, in comparison to standard MIDI notation, since the velocity values degenerate to only seven different quantized states.

The inventive rhythmic pattern encoding is a lossless encoding scheme, which, therefore, can be reversed or decoded, so that a decoded rhythmic pattern is obtained. To this end, the functionalities of the sorter 11, the zero eliminator 12 and the processor 10 from the FIG. 1 encoder scheme have to be reversed. In case of preferable embodiments in which the prime index is used, one would, first of all, perform a prime index/grid position index resorting step. In this case, one would mark the beat positions and the offbeat positions in an empty bit position. One would then start with the highest prime index. When the highest prime index has a non-zero velocity value, this velocity value is sorted into the grid position having the first beat in the grid. The second highest prime index is then used which, when same has a velocity value not equal to zero, is attributed to the second beat in the bar. When the second prime index vector component has an associated velocity value of zero, this means that such a second prime index value does not exist. Therefore, the grid position for the second beat receives a velocity value of zero, etc.

Whether a grid position value receives a zero or not, is determined by checking out as to whether the sequence of prime index values is a non-disturbed sequence from one to the pattern length in one-increment steps or not. When one encounters a missing prime index value, this indicates that the grid position associated to this missing prime index value receives a zero velocity value.

Depending on the requirements, the inventive methods can be implemented in hardware, software or in firmware. Therefore, the invention also relates to a computer readable medium having store a program code, which when running on a computer results in one of the inventive methods. Thus, the present invention is a computer program having a program code, which when running on a computer results in an inventive method.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An apparatus for determining a relation between a test piece of music and a reference piece of music, comprising:

an input interface for providing an encoded rhythmic pattern of the test piece of music, the encoded rhythmic pattern having velocity values associated with grid positions at a first rhythmic level in a first group and having velocity values associated with grid positions at a second rhythmic level in a second group, wherein the first group and the second group are in sequence to each other;

a database having an encoded rhythmic pattern for at least one reference piece of music;

a search engine for comparing the encoded rhythmic pattern of the test piece of music to the encoded rhythmic pattern of the reference piece of music, the search engine being operative to correlate the first group of velocity values of the encoded test rhythmic pattern to a first group of velocity values of the encoded rhythmic pattern for the reference piece of music, before comparing further velocity values; and an output interface for indicating the relation between the test piece of music and the reference piece of music based on the correlation result.

2. The apparatus in accordance with claim 1, in which the search engine is operative to delete a reference piece of music from further consideration when the rhythmic pattern of the reference piece of music has a zero velocity value in the first group at a grid position at which the test rhythmic pattern has a velocity value different from zero before correlating the second group of velocity values.

3. The apparatus in accordance with claim 2, in which the encoded test rhythmic pattern and the encoded reference rhythmic pattern have index values associated with the velocity values in the first group and the second group and in which the encoded rhythmic patterns only include index values for velocity values different from zero;

wherein the search engine is operative to delete the reference rhythmic patterns from further consideration based on a comparison of the index values, so that only reference rhythmic patterns remain for further consideration, which have matching index values with respect to the test rhythmic pattern.

4. A method of determining a relation between a test piece of music and a reference piece of music, the method comprising:

providing an encoded rhythmic pattern of the test piece of music, the encoded rhythmic pattern having velocity values associated with grid positions at a first rhythmic level in a first group and having velocity values associated with grid positions at a second rhythmic level in a second group, wherein the first group and the second group are in sequence to each other and an encoded rhythmic pattern for at least one reference piece of music;

comparing the encoded rhythmic pattern of the test piece of music to the encoded rhythmic pattern of the reference piece of music, the search engine being operative to correlate the first group of velocity values of the encoded test rhythmic pattern to a first group of velocity values of the encoded rhythmic pattern for the reference piece of music, before comparing further velocity values; and indicating the relation between the test piece of music and the reference piece of music based on the correlation result.

5. A computer implemented method comprising a plurality of computer program instructions embodied in a tangible medium comprising a computer memory which, when run on a computer, determines a relation between a test piece of music and a reference piece of music, the method comprising the steps of:

providing an encoded rhythmic pattern of the test piece of music, the encoded rhythmic pattern having velocity values associated with grid positions at a first rhythmic level in a first group and having velocity values associated with grid positions at a second rhythmic level in a second group, wherein the first group and the second group are in sequence to each other and an encoded rhythmic pattern for at least one reference piece of music;

comparing the encoded rhythmic pattern of the test piece of music to the encoded rhythmic pattern of the reference piece of music, the search engine being operative to correlate the first group of velocity values of the encoded test rhythmic pattern to a first group of velocity values of the encoded rhythmic pattern for the reference piece of music, before comparing further velocity values; and indicating the relation between the test piece of music and the reference piece of music based on the correlation result.

* * * * *